US006739117B2

(12) United States Patent
Fietz

(10) Patent No.: US 6,739,117 B2
(45) Date of Patent: May 25, 2004

(54) SUPPORTING DISK FOR SUPPORTING A ROTOR

(75) Inventor: Roland Fietz, Neustadt (DE)

(73) Assignee: Carl Freudenberg KG, Weinheim (DE)

( * ) Notice: Subject to any disclaimer, the term of this patent is extended or adjusted under 35 U.S.C. 154(b) by 38 days.

(21) Appl. No.: 10/081,602

(22) Filed: Feb. 21, 2002

(65) Prior Publication Data

US 2002/0152737 A1 Oct. 24, 2002

(30) Foreign Application Priority Data

Mar. 8, 2001 (DE) ..... 101 11 331

(51) Int. Cl.[7] ..... D01H 4/08
(52) U.S. Cl. ..... 57/404; 57/112
(58) Field of Search ..... 57/404, 405, 406, 57/407, 408, 409, 410, 411, 412, 413, 414, 415, 416, 417, 112

(56) References Cited

U.S. PATENT DOCUMENTS 4,667,464 A 5/1987 Stahlecker et al.
4,892,422 A * 1/1990 Stahlecker ..... 384/549
5,178,473 A * 1/1993 Oexler et al. ..... 384/549
5,517,814 A * 5/1996 Stahlecker ..... 57/406
6,016,649 A * 1/2000 Bock et al. ..... 57/406
6,116,012 A * 9/2000 Braun ..... 57/406

FOREIGN PATENT DOCUMENTS

DE 3826851 A1 * 2/1990 ..... D01H/4/00
DE 197 19 791 11/1998

OTHER PUBLICATIONS

Halliday, Resnick, Walker: "Fundamentals of Physics" 1993, John Wiley & Sons, Inc,.*

* cited by examiner

*Primary Examiner*—John J. Calvert
*Assistant Examiner*—Shaun R Hurley
(74) *Attorney, Agent, or Firm*—Kenyon & Kenyon

(57) ABSTRACT

A supporting disk for supporting a rotor, in particular the rotor on an open-end spinning rotor, having a hub ring and a supporting ring situated on the outer circumference of the hub ring, made of a polymer material, and having a running surface for the rotor, wherein the supporting ring (1) has at least one lip-shaped projection (7) on at least one of its axial end faces (6).

20 Claims, 6 Drawing Sheets

SUPPORTING DISK FOR SUPPORTING A ROTOR

BACKGROUND OF THE INVENTION

1. Field of the Invention

The invention relates to a supporting disk for supporting a rotor, especially an open-end spinning rotor, having a hub ring and a supporting ring situated on the outer surface of the hub ring and made from a polymer material and having a running surface for the rotor.

DESCRIPTION OF RELATED ART

The development of open-end spinning machines has resulted in a constant increase in the rotational speeds of the rotor. To meet the consequently increased and still increasing demands on the temperature resistance of the supporting disks made of a polymer material, harder and more temperature resistant material variations are being used. However, the increasing hardness of the polymer material worsens its damping properties, i.e., the damping is lower.

In U.S. Pat. No. 4,667,464, the running side of the supporting ring is provided with a circumferential groove, thereby also preventing an increase in heat in the central region of the supporting ring. The circumferential ring groove is to improve the heat dissipation, so that the danger of a heat accumulation within the supporting ring is reduced. However, this design approach does not have the desired results in every case.

An improvement is to be achieved by a specific embodiment as shown in DE 197 19 791 having two ring grooves. Although as a result of the interruption of the covering on the supporting ring's running surface the ring grooves have a positive effect on the elastic properties of the supporting ring, they decrease the bearing surface for the rotor. This results in an increased surface pressure, so that a running surface provided with ring grooves is more significantly stressed than a cylindrical running surface without ring grooves.

SUMMARY OF THE INVENTION

Accordingly, it is an object of the invention to improve a supporting disk for a rotor such that the damping of the supporting disk that is reduced when using a harder material is compensated for or even improved, and at the same time, advantages are achieved with regard to the heating and, consequently, the temperature resistance of the supporting disk.

It is another object of the invention to improve the damping properties, in particular in the case of harder polymer materials for the supporting ring, and decrease the surface pressure and heat generation at the supporting ring covering by using the maximum possible contact surface, as well as at the same time to effectively remove the flexing work heat from the covering by increasing its surface area.

These and other objects of the invention are achieved by a supporting disk for supporting a rotor, wherein the supporting ring is provided on at least one of its axial end faces with at least one lip-shaped projection. It turns out that changing the geometric shape of the supporting ring results in significant advantages for the supporting disk.

BRIEF DESCRIPTION OF THE DRAWINGS

The present invention will be described in greater detail with reference to the following drawings wherein.

DETAILED DESCRIPTION OF THE INVENTION

Figure 1:
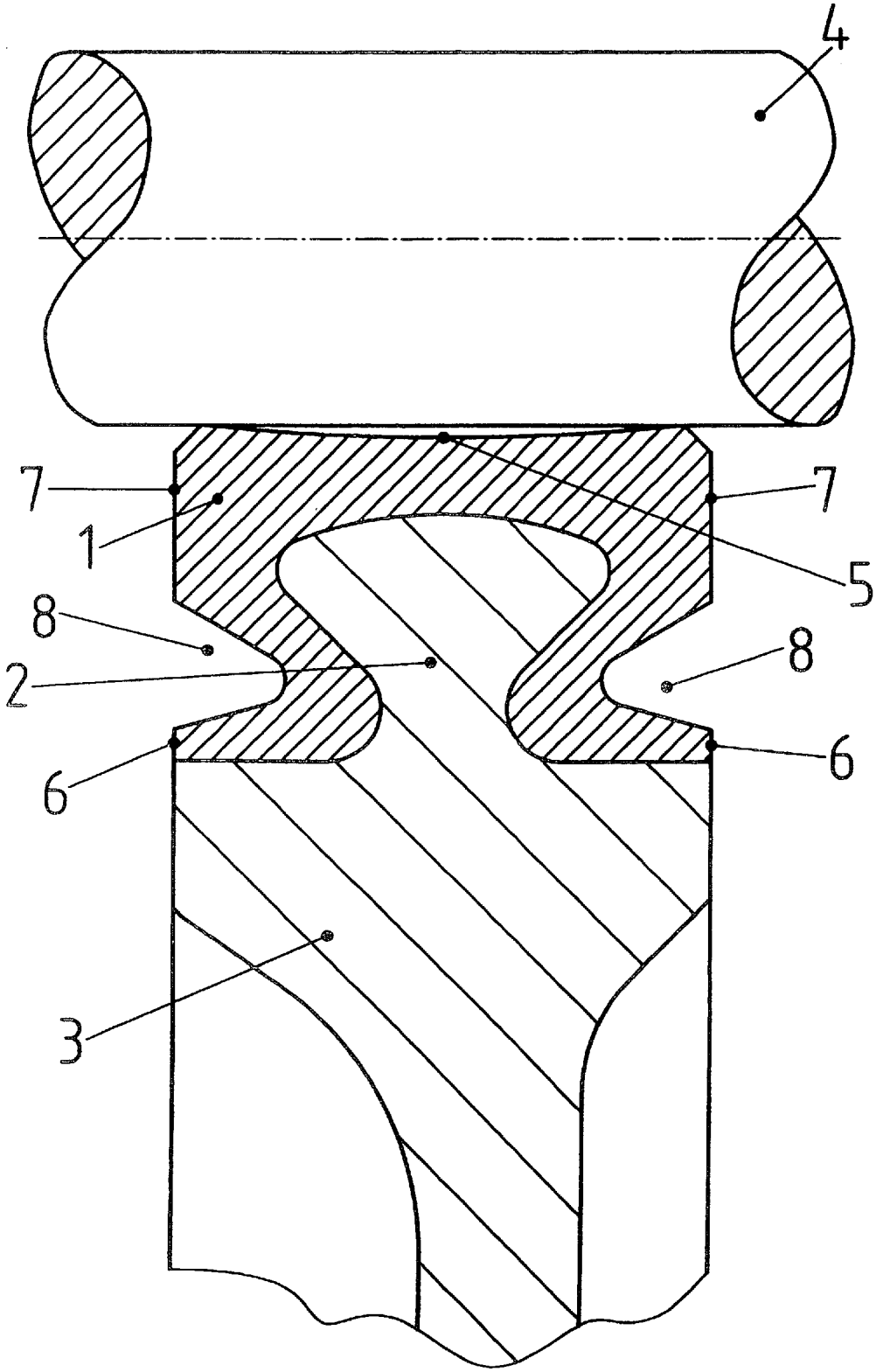
FIG. 1 shows a section of a supporting ring at the hub ring abutting a rotor.

The projections are preferably designed with an outwardly tapering form. The high rotational speeds of the supporting disk and the resulting centrifugal forces lightly expand the diameter of the projections, and as a result, the projections initially partially support the rotor. Consequently, the middle region of the supporting ring, which is typically significantly thermally and dynamically stressed, is unloaded. At the same time, the lip-shaped projections, which are thinner in proportion to the supporting ring as a whole, are able to use the elastic material properties of the material relatively effectively and have a damping effect on the run of the rotor. The lip-shaped projections can be designed to be relatively thin in proportion to the supporting ring as a whole, so that the heating introduced by the deformation energy and the alternating bending load is relatively low. Moreover, the interplay of expansion due to centrifugal forces and partial pushing back by the rotor leads to a ventilation effect and, consequently, to an increased air flow in the region of the projections, which results in a type of cooling effect. The fundamental inventive idea may be achieved by different geometric formations of the supporting ring. Therefore, it is possible to design the running surface for the rotor to be flat. To further support the expansion of the projections, the running surface for the rotor may have a concave design in another instance.

The lip-shaped projections may extend beyond the axial end faces of the supporting ring.

A variation that is able to be produced in a mechanically favorable manner provides that the projection(s) is/are formed by a groove running around the end face of the supporting ring. On the one side, the projection is formed by the groove, and on the other side, the supporting ring surface needed to attach the supporting ring to the hub ring is maintained. The groove itself may have different forms. However, its cross section is preferably V-shaped with a trough-shaped rounding at the bottom of the groove. This prevents abrupt or sharp-edged junctions in the groove region.

A polymer material, preferably polyurethane, whose shore hardness $\geqq 95°$ shore hardness A is used as the material for the supporting ring.

Thus, the hub ring may be Ω-shaped, T-shaped, or V-shaped in the top region. It is also possible to provide the top region of the hub ring with recesses for receiving anchor legs of the supporting ring. Axial borehole are also possible for anchoring the supporting ring to the hub ring.

It is advantageous when the hub ring is produced from a metallic material, in particular from aluminum. A plastic having good thermal conductivity may also be used. A composite material, e.g. a plastic metal, would also be conceivable.

The geometric shape of the cross section of the supporting ring is advantageously designed such that the middle section of the supporting ring supported by the top region of the hub ring has a constant covering thickness. As a result, heat is able to be quickly and uniformly dissipated into the metallic hub ring.

Forming supporting disks for supporting rotors on open-end spinning rotors is known per se. Therefore, only the region of the supporting disks included in the inventive idea is shown in the following figures. Therefore, FIG. 1 shows a cross section of supporting ring 1 including corresponding top region 2 of hub ring 3. Together, supporting ring 1 and hub ring 3 form the supporting disk for supporting rotor 4. The surface of rotor 4 rests against running surface 5 of supporting ring 1. In the present case, running surface 5 is slightly concave. The anchoring or supporting ring 1 to hub ring 3 is strengthened by the Ω-shaped formation in top region 2 of the hub ring. Otherwise, supporting ring 1 is connected to hub ring 3 by vulcanization. Axial end faces 6 of supporting ring 1 are provided with lip-shaped projections 7. Projections 7 are produced by introducing circumferential grooves 8 in end faces 6 of supporting ring 1. Projections 7 have an outwardly tapering form. The form of projections 7 and also of running surface 5 supports rotor 4 in a particularly effective manner.

Figure 2:
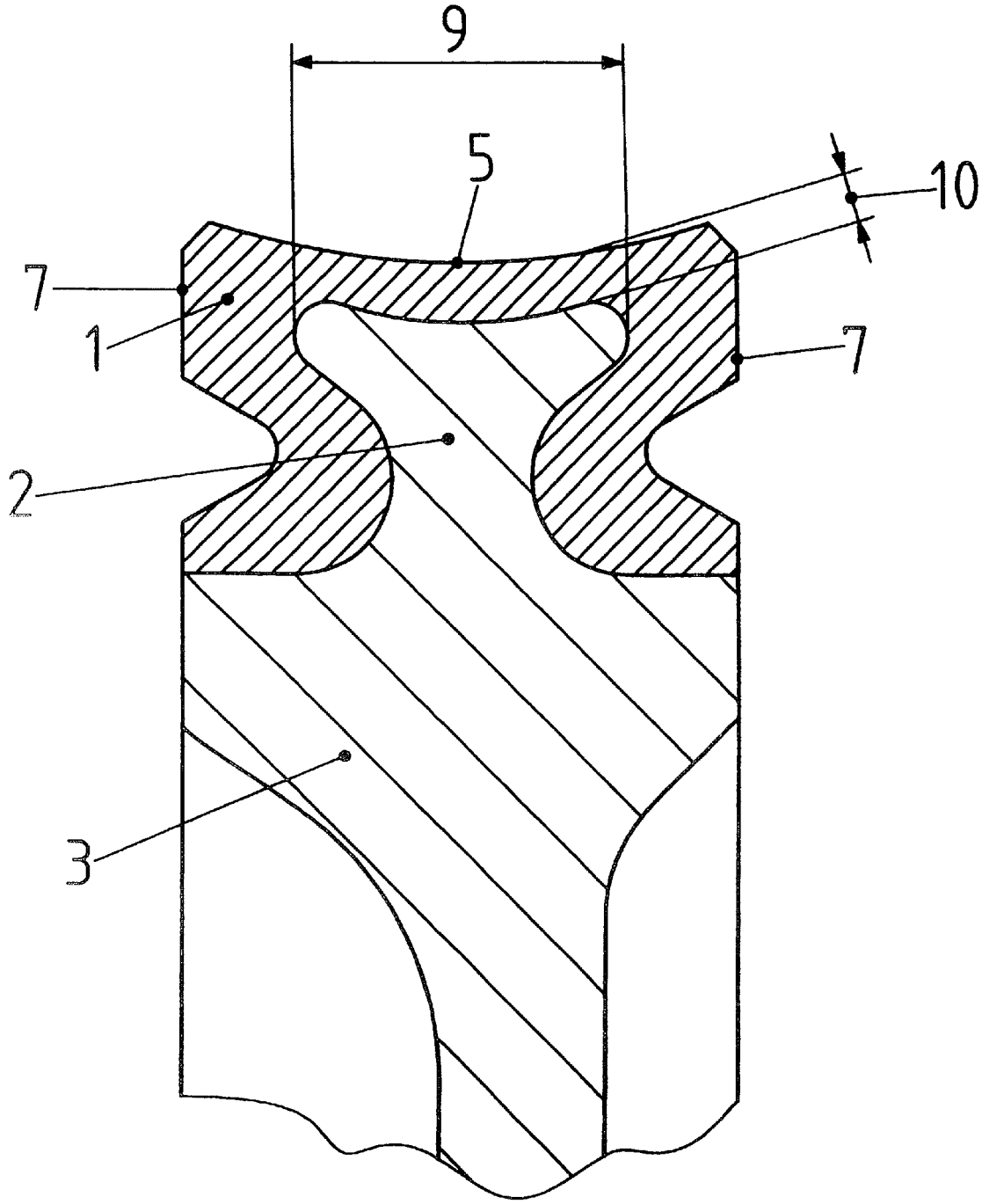
FIG. 2 shows a section of a supporting ring at a hub ring having a kidney-shaped top section.
Figure 3:
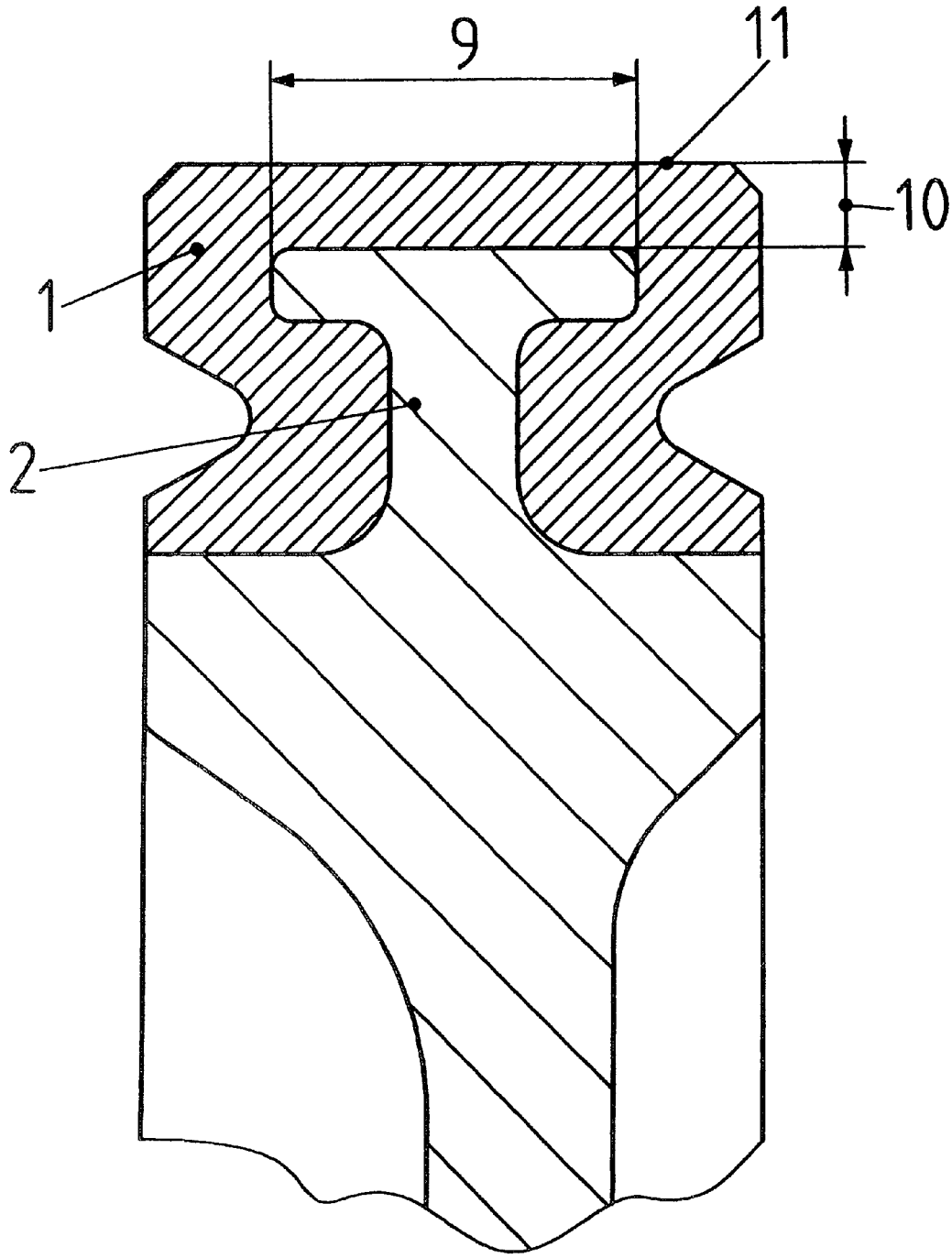
FIG. 3 shows a section of a supporting ring including a T-shaped top section of the hub ring.

The formation of supporting ring 1 and hub ring 3 shown in FIG. 2 fundamentally corresponds to the formation according to FIG. 1 with the difference that top region 2 of hub ring 3 is shaped like a kidney. As a result, middle section 9, which is supported by top region 2 of hub ring 1, of the running side of supporting ring 1 may be designed with a uniform covering thickness 10. Also in the case of top region 2 being designed as shown in FIG. 3, a uniform covering thickness 10 in supported section 9 is possible. In this development, elastic running surface 11 of supporting ring 1 is flat.

Figure 4:
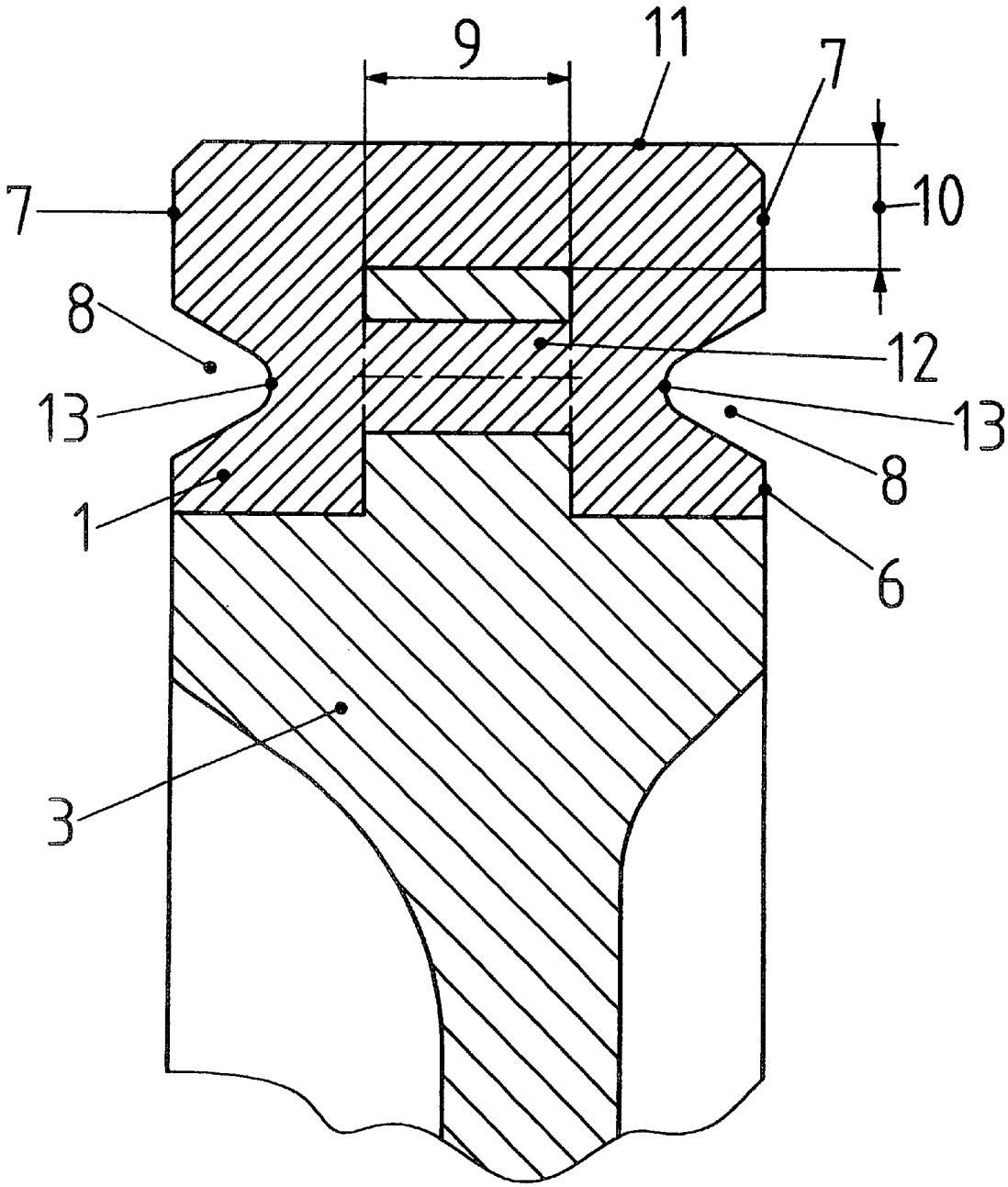
FIG. 4 shows a section of the supporting ring at a hub ring having boreholes for anchoring the supporting ring.

In FIG. 4, running surface 11 is also flat. Supported section 9 has uniform covering thickness 10. Supporting ring 1 is anchored to hub ring 3 by boreholes 12 present in hub ring 3, the boreholes being filled with the polymer of supporting ring 1. Projections 7 are produced by grooves 8 in end faces 6 of supporting ring 1. As in all of the other examples, grooves 8 are V-shaped and are provided with a trough-like groove bottom 13.

Figure 5:
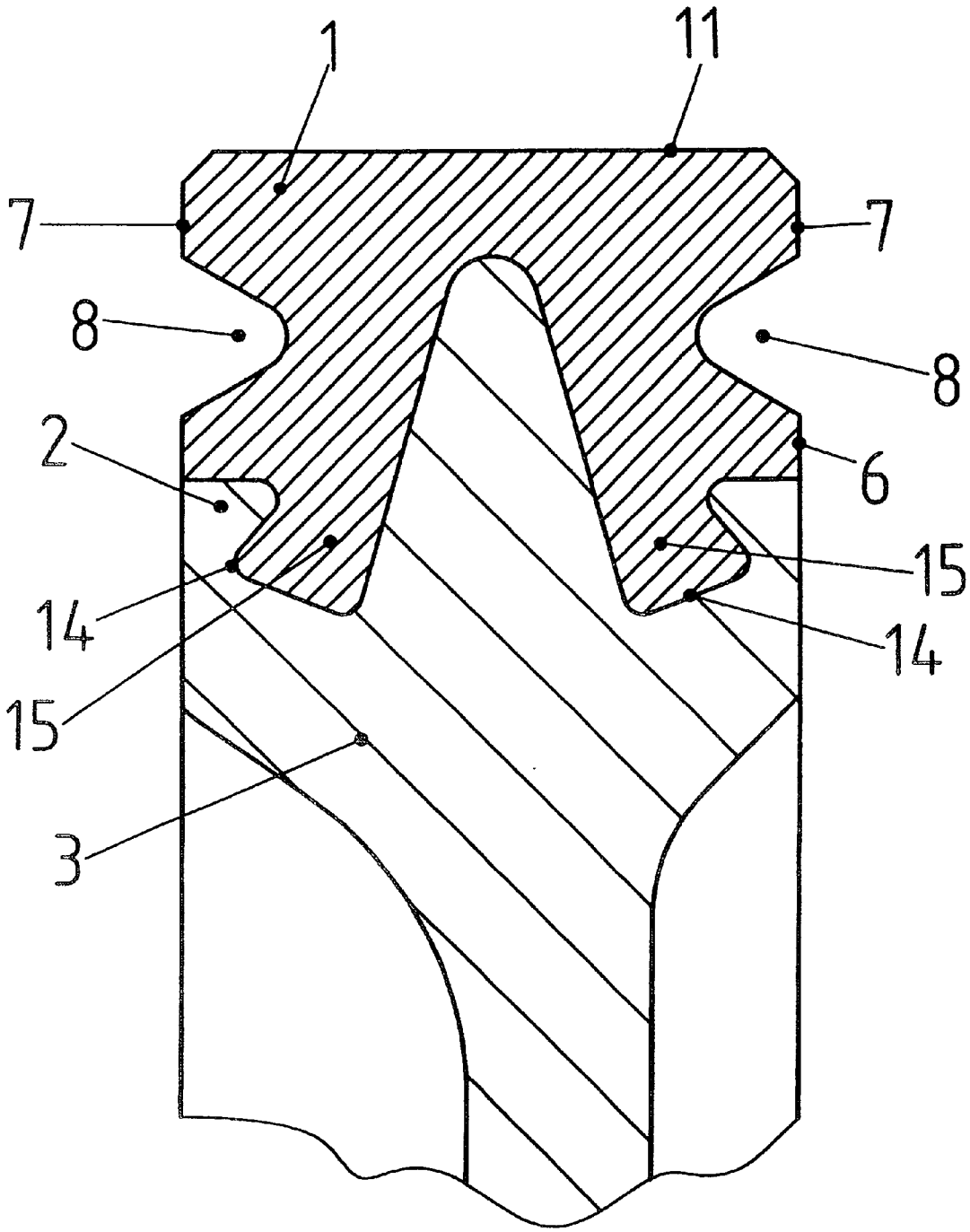
FIG. 5 shows a section of the supporting ring having affixed anchor legs.

FIG. 5 shows a supporting disk where top region 2 of hub ring 3 is provided with recesses 14. Recesses 14 are applied to hub ring 3 in a ring-shaped manner and have a radially inwardly expanded cross section. As a result, anchor legs 15, which are provided on supporting ring 1, are anchored in a particularly effective manner. Running surface 11 is flat and projections 7, which are produced by grooves 8 in end faces 6, are present on every side of supporting ring 1.

Figure 6:
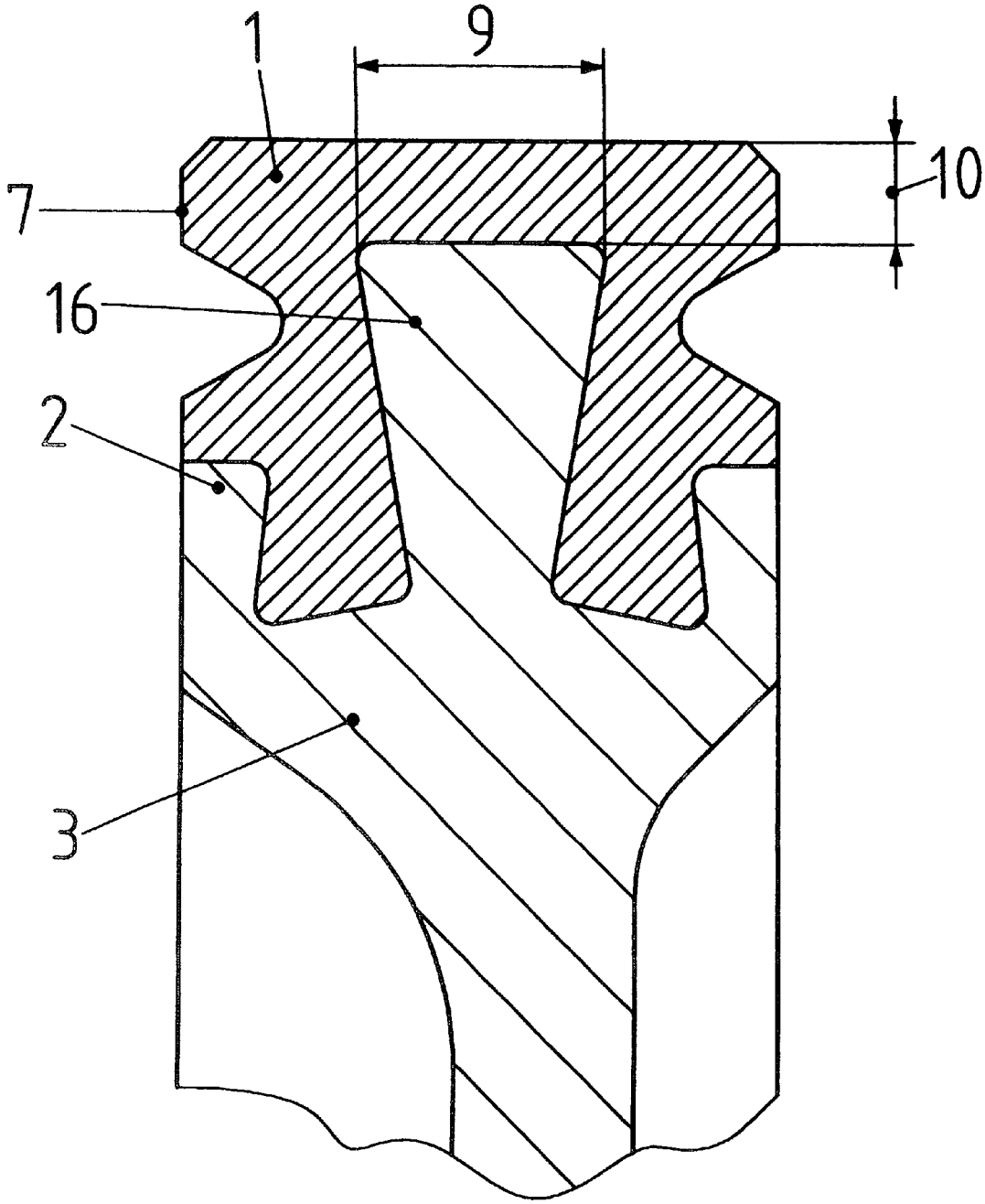
FIG. 6 shows a section of the supporting ring having anchor legs and a V-shaped formation of the top section of the hub ring.

The geometric shape of supporting ring 1 and hub ring 3 in FIG. 6 essentially corresponds to the formation according to FIG. 5 with the difference that top section 2 has a dovetailed extension 16, which enables a uniform covering thickness to be applied in supported section 9 on the running side of supporting ring 1.

What is claimed is:

1. A supporting disk for supporting a rotor, comprising: a hub ring and a supporting ring situated on an outer circumference of the hub ring, made of a polymer material, and having a running surface for the rotor, wherein the supporting ring (1) has at least one projection (7) on at least one of its axial end faces (6), wherein the projection (7) is formed by a circumferential groove (8) in an end face (6) of the supporting ring (1).

2. The supporting disk according to claim 1, wherein the running surface (11) for the rotor (4) is flat.

3. The supporting disk according to claim 1, wherein the running surface (5) for the rotor (4) is concave.

4. The supporting disk according to claim 1, wherein the supporting ring (1) is made of a polymer material having a hardness ≧95° shore hardness A.

5. The supporting disk according to claim 4, wherein the polymer is polyurethane.

6. The supporting disk according to claim 1, wherein the hub ring (3) is essentially V-shaped in a top region (2).

7. The supporting disk according to claim 1, wherein the hub ring (3) has recesses (14) in a top region (2) for receiving anchor legs (15) of supporting ring (1).

8. The supporting disk according to claim 1, wherein the hub ring (3) is made of one of an aluminum metallic material, a plastic material and a composite material.

9. A supporting disk for supporting a rotor, comprising: a hub ring and a supporting ring situated on an outer circumference of the hub ring, made of a polymer material, and having a running surface for the rotor, wherein the supporting ring (1) has at least one lip-shaped projection (7) on at least one of its axial end faces (6) and wherein the projection (7) has an outwardly tapering form.

10. The supporting disk according to claim 9, wherein the running surface (11) for the rotor (4) is flat.

11. The supporting disk according to claim 9, wherein the running surface (5) for the rotor (4) is concave.

12. The supporting disk according to claim 9, wherein the projection (7) is formed by a circumferential groove (8) in an end face (6) of the supporting ring (1).

13. The supporting disk according to claim 9, wherein the hub ring (3) has recesses (14) in a top region (2) for receiving anchor legs (15) of supporting ring (1).

14. A supporting disk for supporting a rotor, comprising: a hub ring and a supporting ring situated on an outer circumference of the hub ring, made of a polymer material, and having a running surface for the rotor, wherein the supporting ring (1) has at least one lip-shaped projection (7) on at least one of its axial end faces (6) and wherein the projection (7) is formed by a circumferential groove (8) in an end face (6) of the supporting ring (1).

15. The supporting disk according to claim 14, wherein the groove (8) is V-shaped and has a trough-like groove bottom (13).

16. A supporting disk for supporting a rotor, comprising: a hub ring and a supporting ring situated on an outer circumference of the hub ring, made of a polymer material, and having a running surface for the rotor, wherein the supporting ring (1) has at least one lip-shaped projection (7) on at least one of its axial end faces (6) and wherein the hub ring (3) is essentially Ω-shaped in a top region (2).

17. The supporting disk according to claim 16, wherein a middle section (9), which is supported by top region (2) of hub ring (1), of the running side of supporting ring (1) has a uniform covering thickness (10).

18. A supporting for supporting a rotor, comprising: a hub ring and a supporting ring situated on an outer circumference of the hub ring, made of a polymer material, and having a running surface for the rotor, wherein the supporting ring (1) has at least one lip-shaped projection (7) on at least one of its axial end faces (6) and wherein the hub ring (3) is essentially T-shaped in a top region (2).

19. The supporting disk according to claim 18, wherein a middle section (9), which is supported by top region (2) of hub ring (1), of the running side of supporting ring (1) has a uniform covering thickness (10).

20. A supporting disk for supporting a rotor, comprising: a hub ring and a supporting ring situated on an outer circumference of the hub ring, made of a polymer material, and having a running surface for the rotor, wherein the supporting ring (1) has at least one lip-shaped projection (7) on at least one of its axial end faces (6) and wherein the hub ring (3) has additional axial boreholes (12) in a top region (2) for anchoring anchor legs (15) of supporting ring (1).

* * * * *